US005791887A

United States Patent [19]

Williams et al.

[11] Patent Number: 5,791,887

[45] Date of Patent: Aug. 11, 1998

[54] SCROLL ELEMENT HAVING A RELIEVED THRUST SURFACE

[75] Inventors: John Robert Williams; Joe Todd Hill; Gene Michael Fields, all of Arkadelphia, Ark.

[73] Assignee: Scroll Technologies, Arkadelphia, Ark.

[21] Appl. No.: 734,415

[22] Filed: Oct. 17, 1996

[51] Int. Cl.[6] ..... F04C 18/04

[52] U.S. Cl. ..... 418/55.2; 418/55.5; 418/57

[58] Field of Search ..... 418/55.2, 55.5, 418/57

[56] References Cited

U.S. PATENT DOCUMENTS

| | | | |
|---|---|---|---|
| 3,884,599 | 5/1975 | Young et al. | 418/55.2 |
| 5,192,202 | 3/1993 | Lee | 418/55.5 |
| 5,342,183 | 8/1994 | Rafalovich et al. | 418/55.2 |
| 5,342,184 | 8/1994 | Comparin et al. | 418/55.2 |
| 5,364,247 | 11/1994 | Fukanuma et al. | 418/55.2 |
| 5,435,707 | 7/1995 | Hirano et al. | 418/55.2 |
| 5,478,219 | 12/1995 | Nardone et al. | 418/57 |
| 5,584,677 | 12/1996 | Ishikawa et al. | 418/55.2 |

FOREIGN PATENT DOCUMENTS

| | | | |
|---|---|---|---|
| 3525933 | 1/1987 | Germany | 418/55.2 |

*Primary Examiner*—John J. Vrablik
*Attorney, Agent, or Firm*—Howard & Howard

[57] ABSTRACT

A scroll compressor (10) is disclosed which includes a fixed scroll element (12) and an orbiting scroll element (14). Each of the scroll elements has a planar surface (18, 24) extending from the wrap on the element to the peripheral edge of the element. A relief area (56) is formed in each of the scroll elements through the planar surface to move the effective pivot point of the intermediate pressure force counteracting the tangential gas force radially inwardly toward the centerline of the scroll elements. A reduction in friction forces is the result, as well as a decrease in the time necessary to work in the scroll elements.

11 Claims, 3 Drawing Sheets

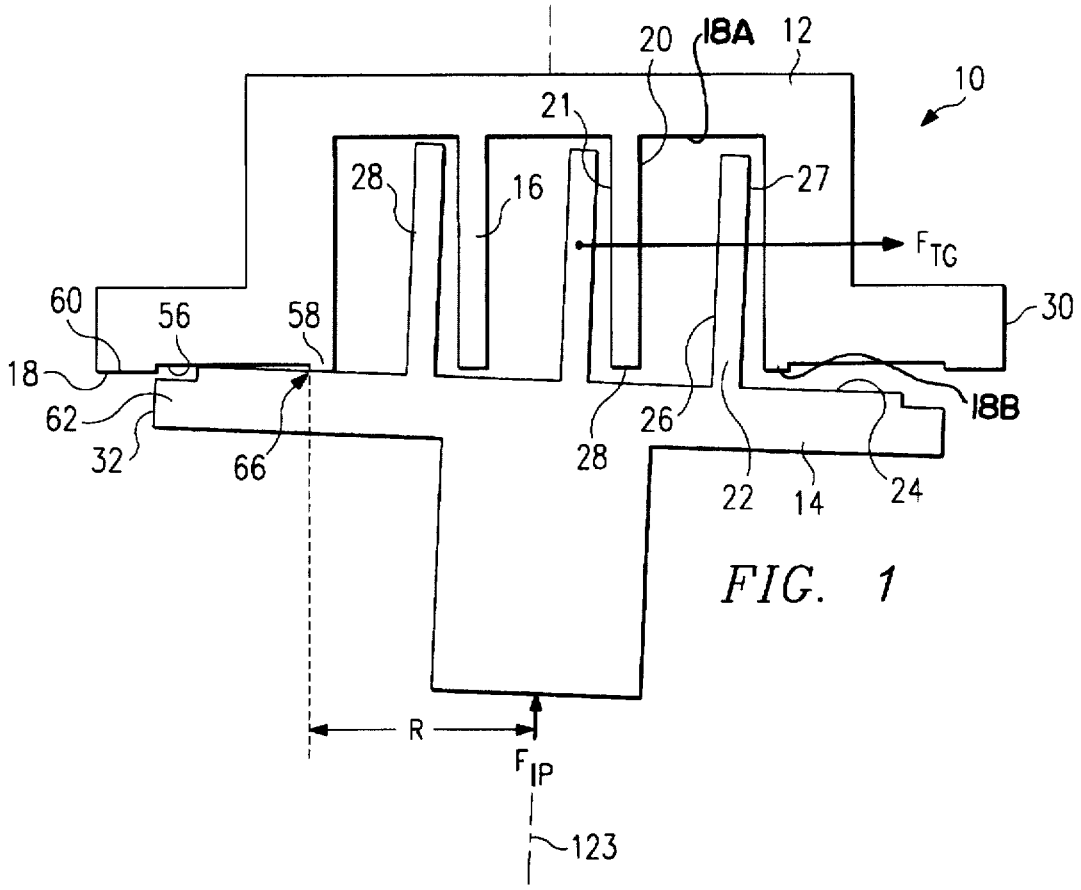
FIG. 1
FIG. 2
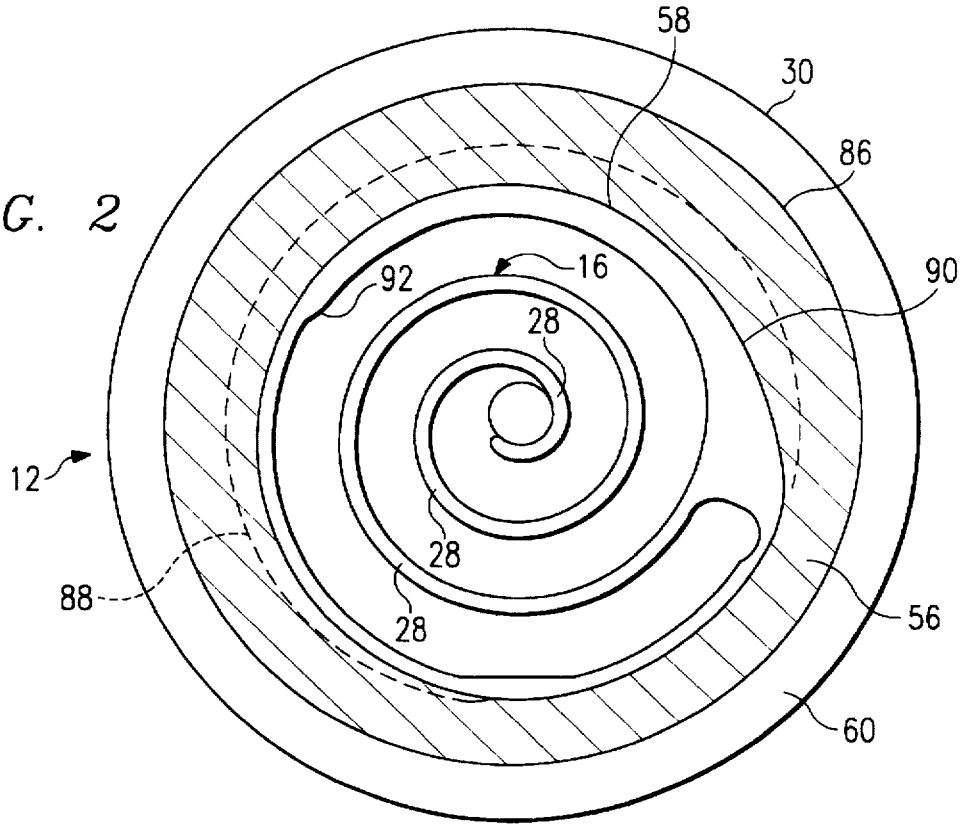

SCROLL ELEMENT HAVING A RELIEVED THRUST SURFACE

TECHNICAL FIELD OF THE INVENTION

This invention relates to compressors, and in particular to scroll compressors.

BACKGROUND OF THE INVENTION

Scroll compressors are used extensively in air-conditioning systems for home and office environments. The scroll compressor typically includes a fixed scroll element and an orbiting scroll element which orbits relative the fixed scroll element. Each of the scroll elements has a scroll wrap formed in an involute curve which engages the scroll wrap on the other scroll element to define compression pockets which compress the refrigerant. The pockets decrease in volume from the outer periphery of the scroll wraps to the center of the scroll elements to compress the refrigerant. The high pressure discharge of the compressed refrigerant occurs at the center of the scroll elements.

Each of the scroll elements has a precisely machined planar surface or floor. The tips of the involute wraps of each of the scroll elements engage in a sealing engagement with the planar surface on the adjacent scroll element. An intermediate pressure port, connecting to one of the compression pockets at a position between the suction pressure and discharge pressure, is fed into a back chamber of the orbiting scroll element to urge the orbiting scroll element and fixed scroll element into proper sealing engagement. The force provided by this intermediate pressure back chamber must overcome the gas forces in compression pockets tending to separate the scroll elements and also must overcome the pivoting moment caused by the tangential gas forces of the refrigerant as it is compressed between the cooperating scroll wraps.

Because of the extensive machining and close tolerances required between the scroll tips and the planar surfaces on the scroll elements, the need exists to develop technologies which reduce the complexity and expense of this interface while maintaining the necessary sealing relationships to properly operate the scroll compressor.

SUMMARY OF THE INVENTION

In accordance with one aspect of the present invention, a scroll element having a planar surface is provided. The scroll element also has a scroll wrap which forms an involute curve extending from an inner point to an outer point. The planar surface extends beyond the outer point to a peripheral edge of the scroll element. A relief area is formed in the scroll element through the planar surface between the outer point and the peripheral edge.

In accordance with another aspect of the present invention, a portion of the planar surface extends from the relief area to the peripheral edge. In accordance with another aspect of the present invention, the relief area extends to the peripheral edge.

In accordance with another aspect of the present invention, the scroll element is a fixed scroll element, an orbiting scroll element pivoting relative to the fixed scroll element through the effect of tangential gas forces about a portion of the planar surface of the fixed scroll element between the outer point and the relief area.

BRIEF DESCRIPTION OF THE DRAWINGS

A more complete understanding of the invention and its advantages will be apparent from the following detailed description when taken in conjunction with the accompanying drawings, in which:

FIG. 1 is a cross-sectional view of scroll elements in a scroll compressor forming a first embodiment of the present invention;

FIG. 2 is a plan view of the fixed scroll to element illustrating the relief area;

DETAILED DESCRIPTION

Figure 3:
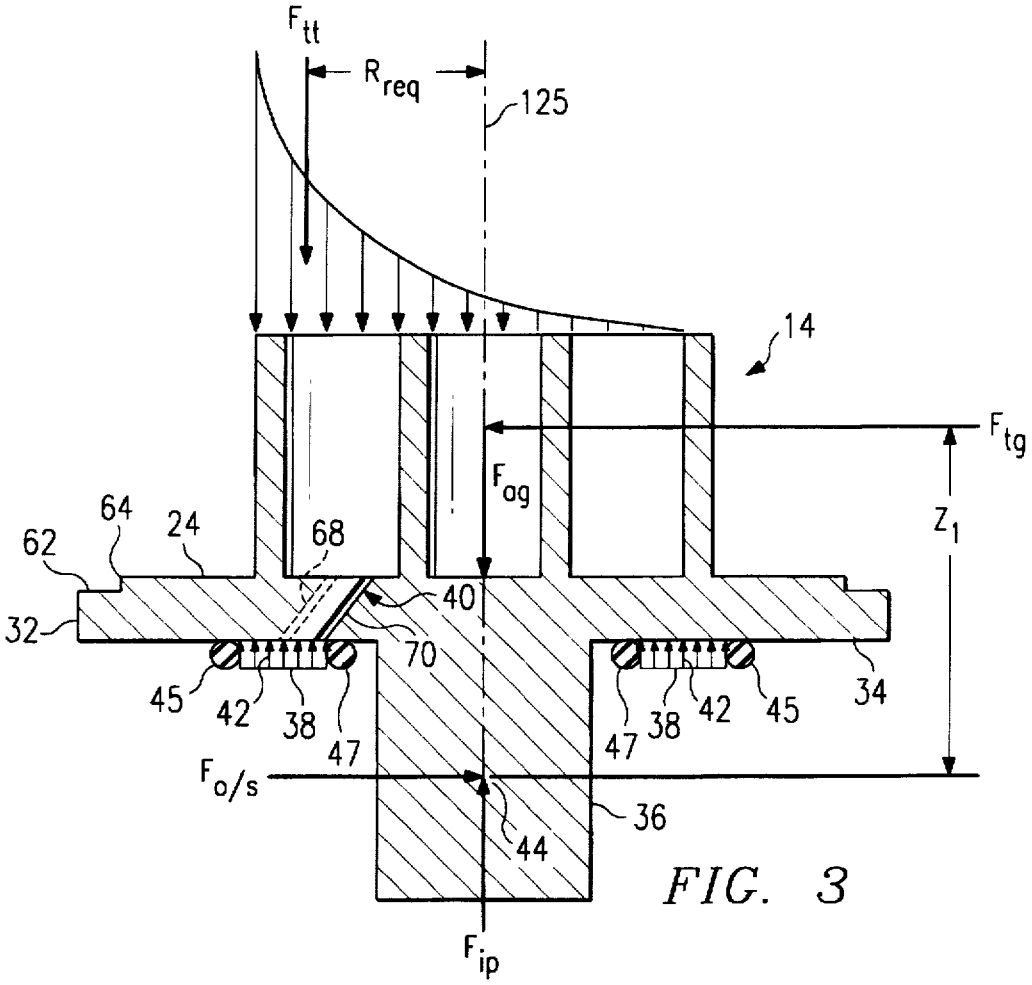
FIG. 3 is a force diagram of the forces acting on the orbiting scroll element.

Referring now to the drawings, wherein like reference characters designate like or corresponding parts throughout the several views, and in particular to FIG. 1, there is illustrated a scroll compressor 10 which can be used to compress a refrigerant for use in a refrigeration cycle in a residence, business or other application. The scroll compressor includes a fixed scroll element 12 and orbiting scroll element 14. The fixed scroll element has a scroll wrap 16 which extends from a floor portion 18A of a planar surface 18 and defines an outer scroll wrap surface 20 and an inner scroll wrap surface 21. Planar surface 18 is formed by the floor portion 18A and a concentric annular portion 18B spaced along the axis 123 of the scroll element 12 from the floor portion 18A. The orbiting scroll element defines a scroll wrap 22 extending from a planar surface 24 which defines an inner scroll wrap surface 26 and an outer scroll wrap surface 27.

As is well understood, the fixed scroll element 12 is held in a fixed relationship within the compressor while the orbiting scroll element 14 is caused to orbit in a circle about an orbital radius while being prevented from rotating relative the fixed scroll element by a mechanism such as an Oldham coupling. Each of the scroll wraps 16 and 22 define seal tips 28 which engage the planar surface 18 or 24 with sufficient force to create a seal therebetween. As can best be seen in FIG. 2, the seal tip 28 of the fixed scroll element 12 merges into the annular portion 18B of the planar surface 18 thereof. Annular portion 18B could, therefore, be referred to as part of the seal tip 28 of fixed scroll element 12 as well. Similarly, the scroll wrap surfaces 20, 21, 26 and 27 are engaged to each other at constantly changing lines of contact as the orbiting scroll element 14 orbits relative the fixed scroll element 12 to define a number of compression pockets which decrease in volume from the outer edges 30 and 32 of the scroll elements to the centers of the scroll elements. Typically, a discharge port is formed proximate the centerline of the scroll elements to discharge the refrigerant at the point of maximum compression at the center.

With reference to FIG. 3, the forces acting on the orbiting scroll element 14 will be described.

The orbiting scroll element 14 has back surface 34 from which extends a cylindrical bearing element 36. The bearing element 36 fits within a crankshaft (not shown) of the scroll compressor. The crankshaft is typically rotated by an electric motor to cause the orbiting motion of the orbiting scroll element 14. The crankshaft drives the orbiting scroll by bearing forces $F_{o/s}$ acting through the bearing center point 44.

A portion of the scroll compressor casing (not shown) forms a surface which faces the back surface 34 of the orbiting scroll element 14. Two seals 45 and 47 are positioned between the back surface 34 and the facing surface of the scroll compressor casing to define an annular intermediate pressure chamber 38. The pressure chamber 38 is connected to one of the compression pockets formed between the scroll wraps of the scroll elements 12 and 14 through an intermediate pressure port 40 extending between the back surface 34 and the planar surface 24. The pressurized gas in chamber 38 creates a force $F_{ip}$ which acts along the axis 125 of orbiting scroll element 14 to maintain the seal tips of the scroll wraps in sealing engagement with the planar surfaces 18 and 24.

As the scroll compressor is operated to compress refrigerant between the scroll wraps of the scroll elements, the gas under compression creates a tangential gas force $F_{tg}$ which is partly balanced by the bearing force $F_{o/s}$ but is also acting through the distance $Z_1$ representing the moment arm between the effective vector of the tangential gas force and the bearing center point 44 of the orbiting scroll element 14. This tangential gas force creates a moment about point 44 which tends to tilt scroll element 14 and separate the seal tips 28 of the scroll elements from the planar sealing surfaces 18 and 24 of the elements. Also, an axial force $F_{ag}$ is created by the gas being compressed between the scroll elements which tends to separate the scroll elements along the axes 123 and 125. (The axes 123 and 125 remain parallel in normal operation of the scroll comparison but axis 125 orbits about axis 123 at the orbital radius of the compressor.) This moment and axial force is counteracted by the pressurized refrigerant in the intermediate pressure chamber 38 acting on the back surface 34, as seen by arrows 42 which forms force $F_{ip}$. The force resisting the moment is the tip thrust force $F_{tt}$ which is the result of the calculation $F_{tt}=F_{ip}-F_{ag}$. This force $F_{tt}$ acts through a moment arm defined as radius R, as seen in FIG. 1, where the planar surface 24 of the orbiting scroll element 14 pivots on the planar surface 18 of the fixed scroll element 12. In conventional scroll compressors, where planar surfaces 18 and 24 extend to near or at the outer edges 30 and 32 of the scroll elements, the pivot will be near the edges.

Figure 4:
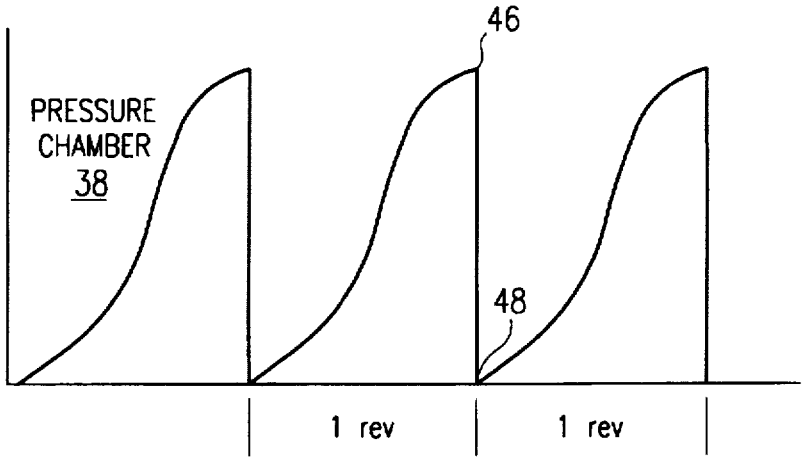
FIG. 4 is a graph illustrating the variation of the intermediate pressure in the intermediate pressure chamber counteracting the moment created by the tangential gas force.
Figure 6:
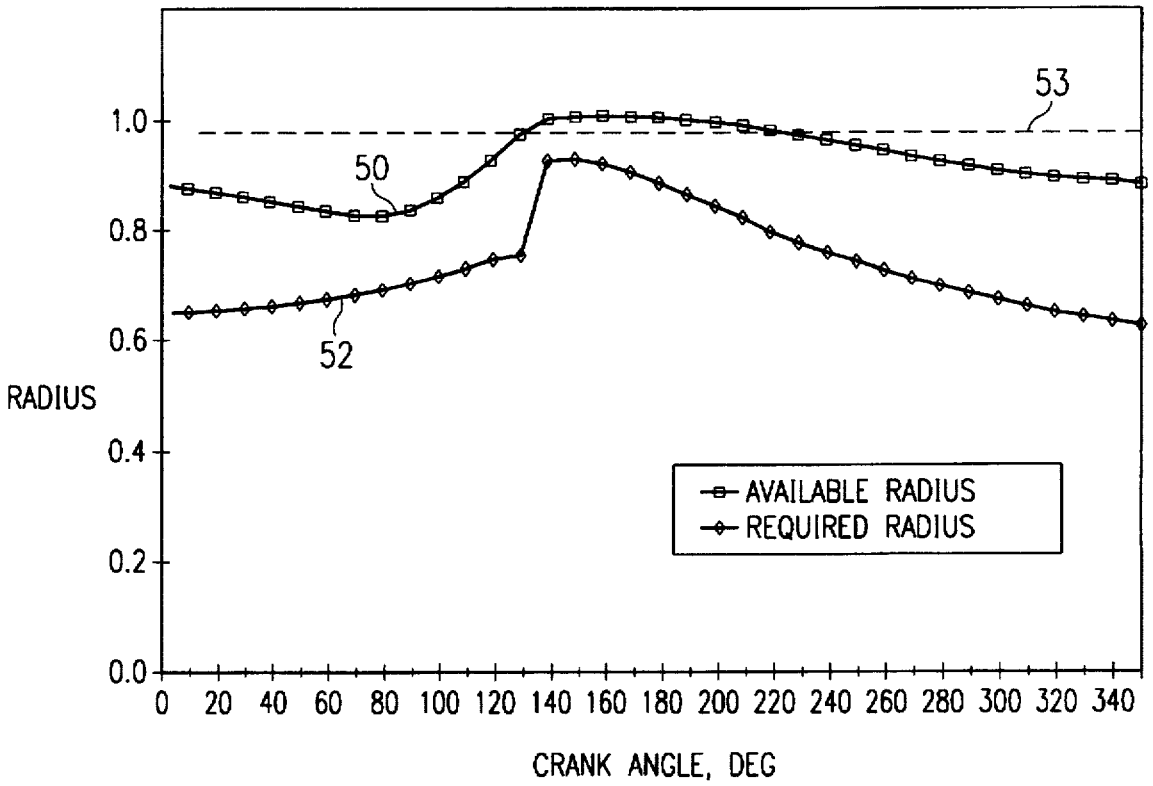
FIG. 6 is a graph of the required radius versus compressor crank angle.

The various forces are dynamic. For example, the intermediate pressure in chamber 38 varies with each complete orbit of orbiting scroll element 14 as illustrated in FIG. 4. As the orbiting scroll element 14 orbits relative the fixed scroll element 12, a particular compression pocket will be moved over the port 40. As the orbiting scroll element 14 continues its orbiting motion, the compression pocket decreases in volume, increasing the pressure both in the pocket and the chamber 38 until the pocket moves radially inward of the port 40 at the maximum pressure point 46. The next compression pocket then opens onto the port 40 at a lower intermediate pressure, causing the pressure in the chamber 38 to drop precipitously to the minimum pressure 48 to begin the cycle anew. The difference between the maximum and minimum pressures occurs every full orbit of the orbiting scroll element 14. Similarly, the radius R of scroll compressor 10 through which the intermediate pressure chamber 38 acts to resist the tangential gas moment varies as the orbiting scroll element rotates as well as illustrated in line 50 in FIG. 6. Line 52, connecting the triangular dots in FIG. 6, plots the ideal required radius R versus the crank angle in degrees necessary for the intermediate force available at that crank angle to prevent tipping. The tangential gas force itself will vary, causing a variable tip moment as illustrated in line 52 of FIG. 6. The line 50, illustrated by the square data points, represents the available radius in the actual scroll compressor 10, defined at any given instance between the point 66 forming the pivot point at the given crank angle, and the center line of the scroll compressor created by forming the relief areas 56 and 62 described hereinafter. In a conventional scroll compressor having no relief areas, the radius R is a straight line 53 as illustrated in FIG. 6 which represents the fact that the radius in the conventional scroll compressor is relatively constant and formed at the line of contact between the outer edges of the fixed and orbiting scroll elements. In the conventional scroll compressor, the radius must exceed the highest radius in the required radius 52 to prevent tipping. However, as the required radius 52 decreases significantly from the highest required radius during a complete 360° cycle, the separation at any given crank angle between the required radius and the constant radius of the conventional scroll compressor represents a condition where the counterbalancing forces exceed significantly those forces necessary to simply counteract the tipping forces, which results in unnecessary friction losses. In the present invention, it is proposed to have the available radius line 50, defined by the relief areas 56 and 62, as closely follow the contour of the required radius line 52 as is practical.

Figure 5:
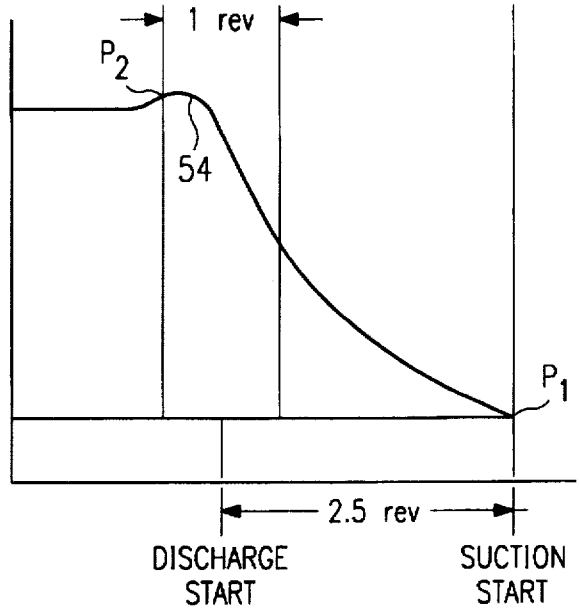
FIG. 5 is a graph of pressure versus rotation in a compression cycle illustrating the increase in pressure of a pressure pocket.

FIG. 5 illustrates the increase in pressure of the gas in a compression pocket as the pocket moves radially inward and is compressed by the scroll elements. The refrigerant gas is at a lower, suction pressure P1 as the pocket is initially formed between the scroll elements near the outer edges thereof. The pressure rises as the orbiting scroll element 14 orbits and the pocket is moved radially inward toward the centerline of the scroll elements. At point 54, the scroll pocket first begins discharge into the discharge port at the discharge pressure P2 into the high pressure side of the compressor. The discharge port is opened to the compression volume for a revolution of the orbiting scroll element with the pressure remaining relatively constant. In a typical scroll compressor, the orbiting scroll element 14 may rotate 2½ revolutions before the compression pocket is moved from the suction side to the discharge side. While FIG. 5 generally shows an increase in gas pressure to the discharge pressure P2, depending on the particular design of the scroll compressor, the pressure within an intermediate pocket can exceed the actual discharge pressure. This is particularly likely to occur when a low pressure ratio, for example 2.0, is used in a compressor which is designed for a higher pressure ratio, i.e., 2.5. Thus, while generally moving the intermediate pressure port 40 radially inward toward the discharge port of the scroll compressor would tend to increase the pressure in the intermediate chamber, this is not always so. If a larger portion of the dwell time of the intermediate port is provided during an interval when the pocket has opened to the discharge pressure, and the discharge pressure is less than the pressure achieved by the closed pocket immediately prior to its opening into the discharge port, the average intermediate pressure may actually be less.

With reference to FIGS. 1 and 2, one significant advantage of the present invention will be illustrated. Prior designs for scroll elements 12 and 14 generally had planar surfaces 18 and 24 which extended between the centerline of the scroll elements to the outer edges 30 and 32 of the scroll elements. In particular, annular portion 18B of planar surface 18 was formed as a precision flat surface over its entire extent (out to line 86). However, fixed scroll element 12 has an annular relief area 56 which extends radially between a portion 58 of the planar surface 18 and a portion 60 of planar surface 18 at the outer edge 30. Similarly, an annular relief area 62 is formed through the planar surface 24 of the orbiting scroll element 14 which extends from portion 64 of planar surface 24 to the outer edge 32 of the orbiting scroll element 14.

With reference to FIG. 2, the outer edge 30 of the fixed scroll element 12 is illustrated. The line 86 represents the outer edge of the precision machined portion of the planar surface 18 in the conventional design. The annulus between line 86 and outer edge 30 is usually provided with bolt holes to bolt the scroll element into the compressor and is not precision machined. Line 88 represents the turning circle on the lathe necessary to prevent interference with the scroll seal tip 28 in lathe machining operation. Thus, one possible embodiment of the present invention is to form the relief area 56 as an annulus between lines 86 and 88. Line 90 represents a maximum potential relief area limit to avoid interference with the scroll tip 28 and another embodiment of the present invention can create the relief area 56 between lines 86 and 90. Point 92 represents the end of the working involute or scroll wrap 16.

This design has a number of advantages. In the past, the entire planar surface 18 from portion 58 to line 86 near the outer edge 30 and the entire planar surface 24 from scroll wrap 22 to outer edge 32 had to be formed with extremely tight tolerances. Any bumps, notches or waves formed in the planar surfaces would interrupt the optimal operation of the scroll compressor. While such surface imperfections may be worn flat as the scroll compressor operates, this creates a relatively lengthy working-in period where the scroll compressor is not working at maximum efficiency. Further, near the edge 32 of the orbiting scroll element 14, an upraised curl was often generated through the operations necessary to form the orbiting scroll element 14, including clamping the scroll element for machining. This curl also required significant working in time for the scroll compressor until the curl is worn down to the planar surface.

In the design of the present invention, the orbiting scroll element 14 will pivot about a pivot point 66 formed on fixed scroll element 12 at portion 58, causing the moment radius R to be moved inward from the prior design. Because of the relief areas 56 and 62, the position of the pivot point 66 is more predictable and constant, allowing the scroll compressor to be more optimally designed for maximum efficiency. The only sealing desired is between the tips 28 of the scroll element and those portions of the planar surfaces 18 and 24 against which the tips are engaged. The relief areas need to be deep enough to prevent contact between the scroll elements radially outside a circle including point 66 during normal operation. Of course, point 66 travels along the entire outer edge of portion 58 as the orbiting scroll element orbits relative the fixed scroll element. If the relief area 56 is sufficiently deep, the relief area 62 may not be necessary to realize the advantages of the present invention. An engagement between the large portions of the planar surfaces 18 and 24 radially outside of the scroll tips is not helpful to the required sealing action. However, in the prior designs without relief areas 56 and 62, these surfaces 18 and 24 were in engagement, generating frictional forces and creating leakage paths.

As the present invention decreases the radius R, the intermediate pressure force can be adjusted to compensate for the reduction in moment arm. To achieve this, the intermediate pressure port 40 can be moved radially inward from a position 68 used to optimize performance of a scroll compressor without relief areas 56 and 62 to position 70. In position 70, the intermediate pressure port 40 is in communication with a compression pocket which is more sensitive to discharge pressure resulting in higher average intermediate pressure at high pressure ratio conditions, creating higher average pressure in the chamber 38. The higher average pressure, therefore, generates the additional force $F_{ip}$ necessary for high pressure ratio operation.

Although a single embodiment of the present invention has been illustrated in the accompanying drawings and described in the foregoing detailed description, it will be understood that the invention is not limited to the embodiment disclosed, but is capable of numerous rearrangements, modifications and substitutions of parts and elements without departing from the scope and spirit of the invention.

We claim:

1. A scroll element for a scroll compressor, the scroll element having a precision machined planar surface, an annular outer surface having an inner radius and an outer radius and a scroll wrap, the scroll wrap having a seal tip thereon which extends from an inner point to an outer point on the scroll element, the precision machined planar surface, annular outer surface and seal tip being substantially co-planar in a first plane;

the precision machined planar surface extending beyond the outer point of the seal tip;

a relief area recessed from the first plane formed in the scroll element through the precision machined planar surface between the outer point of the seal tip and the inner radius of the annular outer surface.

2. The scroll element of claim 1 wherein a portion of the planar surface extends from the outer point of the scroll wrap to the relief area, the relief area extending to the peripheral edge.

3. The scroll element of claim 1 wherein a portion of the planar surface extends from the relief area to the peripheral edge of the scroll element.

4. The scroll element of claim 1 being a stationary scroll element.

5. The scroll element of claim 1 being an orbiting scroll element.

6. A scroll element for a scroll compressor, the scroll element having a center line, a planar surface and a scroll wrap, the scroll wrap having a wrap surface thereon which extends from an inner point to an outer point on the scroll element;

the planar surface extending beyond the outer point of the wrap surface to a peripheral edge of the scroll element;

a relief area formed in the scroll element through the planar surface beginning at a circle defined by the radial distance between the outer point and the center line of the scroll element and extending toward but not extending to the peripheral edge.

7. A scroll element for a scroll compressor, the scroll element having a precision machined planar surface a relief area with a radially inner edge and a scroll wrap, the scroll wrap having a seal tip thereon which extends from an inner point to an outer point on the scroll wrap, the scroll element having a central axis, the planar surface extending radially from the central axis beyond the outer point of the seal tip to a peripheral edge having a circumference, the radial distance from the central axis to the peripheral edge varying around the circumference of the peripheral edge, the peripheral edge forming the radially inner edge of the relief area.

8. A scroll compressor, comprising:

a fixed scroll element having a planar surface and a scroll wrap, the scroll wrap having a wrap surface thereon extending from an inner point to an outer point on the planar surface, the planar surface extending from the outer point to the peripheral edge of the fixed scroll element, a relief area formed in the scroll element through the planar surface between the outer point and the peripheral edge;

an orbiting scroll element having a planar surface, a back surface and a scroll wrap, the scroll wrap having a wrap surface thereon extending from an inner point to an outer point on the planar surface, the planar surface extending beyond the outer point to a peripheral edge of the orbiting scroll element, a relief area formed in the orbiting scroll element through the planar surface between the outer point and the peripheral edge of the orbiting scroll element;

means for exposing a portion of the back surface of the orbiting scroll element to intermediate pressure to counteract a tipping moment from tangential gas forces, the orbiting scroll element pivoting relative the fixed scroll element about a point formed on the fixed scroll element between the outer point of the fixed scroll element and the relief area of the fixed scroll element.

9. A scroll compressor including a first scroll element having a planar surface and a scroll wrap, the scroll wrap having a seal tip thereon which extends from an inner point to an outer point on the scroll element, the planar surface extending beyond the outer point of the seal tip to a peripheral edge of the first scroll element, a relief area formed in the first scroll element through the planar surface between the outer point of the seal tip and the peripheral edge;

a second scroll element having a scroll wrap, the scroll wrap engaging the scroll wrap of the first scroll element, said second scroll element further having a wrap surface thereon;

the first and second scroll elements each having a central axis, pressurized gas in pockets formed between the scroll wraps tending to separate the first and second scroll elements from each other;

means for urging the scroll wraps of the first and second scroll elements into engagement to counteract the gas force tending to separate the first and second scroll elements, said means including a force creating a moment pivoting about an instantaneous pivot point on the first scroll element at a first radial distance from the center axis of the first scroll element, the radial distance of the instantaneous point from the central axis of the first scroll element varying as the first and second scroll elements orbit relative one another.

10. The scroll compressor of claim 9 wherein the gas compressed in the pockets between the first and second scroll elements creates a moment tending to separate the wrap surfaces, the separation moment varying due to the variation of pressure in the pockets and location of the pockets as the first and second scroll elements orbit relative each other, the radial distance of the instantaneous point from the central axis of the first scroll element being varied to compensate for the variation in separation moment to minimize the force necessary to counteract the separating moment.

11. An improved scroll compressor having a first scroll element and a second scroll element, each of said scroll elements having a scroll wrap for engaging the other scroll wrap to define pockets therebetween for compressing a gas, the scroll compressor having a mechanism for orbiting at least one of the scroll elements relative the other to compress the gas in the pockets, the gas being compressed in the pockets tending to separate the scroll wraps from each other, the scroll compressor having a mechanism to generate a force to counteract the force generated by the gas in the pockets, the force exerted by the gas pressure in the pockets tending to tilt one of the scroll elements relative the other scroll element, the scroll compressor having means to generate a compensating force creating a moment about a continuously moving pivot point of contact between a planar surface on the first scroll wrap and a planar surface on the second scroll wrap, the force exerted by the gas in the pockets varying so that the compensating force necessary to exactly compensate can be viewed to act through a continuously varying required radius, at least one of the scroll elements defining a planar surface extending beyond the outer limit of the wrap surface thereon to a peripheral edge of the scroll element, a relief area formed in the scroll element through the planar surface between the outer point of the wrap surface and the peripheral edge to define a circumference upon which the other of said scroll elements will pivot at the instantaneous pivot point, the radius of the circumference varying continuously to conform closely to the required radius of the scroll compressor.

* * * * *